United States Patent [19]

Christensen et al.

[11] 4,395,193

[45] Jul. 26, 1983

[54] MATERIAL HANDLING BUCKET

[75] Inventors: Robert B. Christensen, Kenosha, Wis.; Lee F. Kramer, Waukegan, Ill.

[73] Assignee: Dresser Industries, Inc., Dallas, Tex.

[21] Appl. No.: 251,004

[22] Filed: Apr. 3, 1981

[51] Int. Cl.[3] ..... B66F 9/06

[52] U.S. Cl. ..... 414/722; 37/118 R

[58] Field of Search ..... 414/722, 723, 724; 172/778, 272; 37/118 R, DIG. 12

[56] References Cited

U.S. PATENT DOCUMENTS

| | | | |
|---|---|---|---|
| Re. 29,603 | 4/1978 | Oke et al. | 37/118 R X |
| T981,001 | 4/1979 | McReynolds | 37/118 R |
| 2,732,963 | 1/1956 | Grubich | 414/699 |
| 2,738,084 | 3/1956 | Schulz | 298/11 |
| 2,753,059 | 7/1956 | Pilch | 414/713 |
| 2,783,903 | 3/1957 | Beyerstedt | 414/722 X |
| 2,929,521 | 3/1960 | Beyerstedt | 414/713 X |
| 3,003,652 | 10/1961 | Henry | 414/715 |
| 3,246,778 | 4/1966 | Kampert et al. | 414/710 |
| 3,807,587 | 4/1974 | Maurer | 37/118 R |
| 3,853,232 | 12/1974 | Oke et al. | 37/118 R X |
| 4,086,712 | 5/1978 | McReynolds | 414/722 X |
| 4,154,349 | 5/1979 | Christensen | 414/720 |

*Primary Examiner*—Robert J. Spar
*Assistant Examiner*—Donald W. Underwood
*Attorney, Agent, or Firm*—B. E. Deutsch

[57] ABSTRACT

A stress distributing plate member for a bucket tilting hinge bracket attached to the exterior wall of a material handling bucket.

11 Claims, 12 Drawing Figures

12
10
11
13
14
20
16
15
30
17
27
18
23
31

25
36
40
24
27
41
21
17
50
21
23
11
18
10
14
16
22
20
11
13

MATERIAL HANDLING BUCKET

This invention relates to material handling bucket structures, and in particular to bucket bowl reinforcement rib members reinforcing the bucket bowl and providing connecting hinge means for attaching the bucket structure to power actuated linkages carried on bucket loader vehicles.

In present day bucket loader vehicles, such as those used in mining operations, the machines and the material handling buckets are enormous in size and weight. A typical mining bucket has a capacity of twenty-two cubic yards or 16.8 cubic meters. The breakout force which is required to roll a filled bucket of this capacity, from a horizontal dig and fill position to a vertical transport position, is in the range of 192,500 pounds or 856,240 newtons.

The bucket tilting linkage is of Z-bar arrangement where there is a single link bar centrally hinge connected to a pair of reinforcement straps or ribs welded to the exterior of a generally hyperbolic shaped bucket bowl. Bearing means are provided at the upper forward portion of the reinforcement straps or ribs. The lower wall of the bucket bowl is generally horizontal and carries a scraper or cutter bar means. The upper wall of the bucket bowl generally extends forwardly and upwardly from the curved portion of the hyperbolic shaped bucket shell and carries a material spill prevention bar. The scraper bar and the spill bar define a forwardly opening scoop. The lateral sides of the bucket shell are closed by vertical plates. Returning now to the further description of the Z-bar arrangement, the link bar extends rearwardly and substantially horizontally and is pin connected at the opposite end to a swingable depending arm of a bellcrank member which is journally mounted midway to a transversely extending beam connecting two parallel longitudinal boom arms. The swinging ends of the boom arms are hinge end connected respectively to two additional pairs of right and left reinforcement straps or ribs welded to the exterior of the bucket bowl. The right and left pairs of reinforcement straps or ribs carry bearings at the bottom portions thereof for mounting the swingable ends of the boom arms thereto. An upwardly extending rock arm of the bellcrank member is pin connected to a generally horizontally extending hydraulic piston cylinder jack unit which is pivotally mounted on the chassis of the power loader vehicle. The assembled bucket tilting linkage thus forms a general Z-shape when viewed from the side of the power loader vehicle. A single bucket tilting link is shown in the U.S. patent application, Ser. No. 207,105, filed on Nov. 17, 1980 by Thomas W. Kerkman and assigned to the International Harvester Company, as opposed to the dual bucket tilting links shown in the U.S. Pat. No. 4,154,349—Christensen—May 15, 1979 and U.S. Pat. No. 3,246,778—Kampert et al—Apr. 19, 1966.

The upper wall of the bucket is reinforced by a transversely extending torque bar or angle member which is welded to the exterior of the bucket shell adjacent the spill bar. The terminal ends of the middle pair of bucket reinforcement ribs are connected by welding to the torque bar or angle member. U.S. Pat. No. 2,783,903—Beyerstedt—Mar. 5, 1957 and U.S. Pat. No. 3,807,587—Maurer—Apr. 30, 1974, each show dual bucket tilt linkage hinge straps which have the terminal ends connected to a transverse torque bar, angle member, reinforcing the spill bar on the upper forward wall of the bucket. In the dual bucket tilt linkage hinge straps shown in these two patents, the brakeout forces are distributed at two sides of the bucket, whereas in the single bucket tilt linkage hinge straps shown in the Kerkman patent application, the forces are concentrated at the mid section of the torque bar. The tremendous brakeout forces exerted by the bucket tilt link have developed cracks in the torque bar. We have discovered that by mounting a stress distributing or load resisting member across the terminal ends of the middle bucket reinforcement and tilt linkage hinge means at the connection to the torque bar, the stresses are absorbed by the load resisting member and no cracks develop in the transverse torque bar. In three decades, there was no appreciable problem with the hinge connection of the bucket tilt linkage to the torque bar due to the relatively small capacity of the earlier buckets. Most of the problems were with reinforcing the lower forward bucket wall, as shown for example in the following U.S. Patents:

U.S. Pat. No. 2,732,963—Grubick—Jan. 31,1956
U.S. Pat. No. 2,738,084—Schulz—Mar. 13, 1956
U.S. Pat. No. 2,753,059—Pilch—July 3, 1956
U.S. Pat. No. 2,929,521—Beyerstedt—Mar. 22, 1960
U.S. Pat. No. 3,003,652—Henry—Oct. 10, 1961
Re. 29,603—Oke et al.—Apr. 4, 1978
U.S. Pat. No. 4,086,712—McReynolds—May 2, 1978
U.S. Pat. No. T 981,001—McReynolds—Apr. 3, 1979

The stress distributing or load resisting member of our invention is made of a ductile flat plate material and is generally elliptical in shape. At least one hole is provided on the minor axis offset from the major axis of the elliptical shaped plate which is centered between the middle pair of bucket reinforcement ribs and tilt linkage hinge means. A pair of rectangular notches or cutouts are provided on equal opposite sides of the minor axis in the curved edge extending toward the major axis. The notches or cutouts fit over the terminal ends of the bucket reinforcement ribs and tilt link hinge means connected to the transverse torque and reinforcement bar extending along the upper forward bucket wall. The body of the generally elliptical shaped flat plate is worked to conform to the shape of and to fit over the torque bar and is connected thereto by welding. Additional stress concentration points may be added to the body of the load resisting member in the way of two additional holes on the major axis on equal opposite sides of the minor axis, and by the addition of a semi-circular or semi-elliptical notch between the pair of rectangular notches, and by the addition of inner tabs or fingers increasing the depth at one side of the pair of rectangular notches, and by the addition of inner and outer tabs or fingers increasing the overall depth of the rectangular notches. The abrupt changes in the cross section of the generally elliptical shaped stress member relieves stresses evenly throughout the member. The stress concentrations at the single hole or at the triple holes and at the semi-circular or semi-elliptical notch between the pair of rectangular notches are removed as the fibers and the cross section are strained to their maximum elastic limit.

The various figures in the accompanying drawing illustrate a suitable arrangement for a constructive practice of our invention, wherein.

Figure 2:
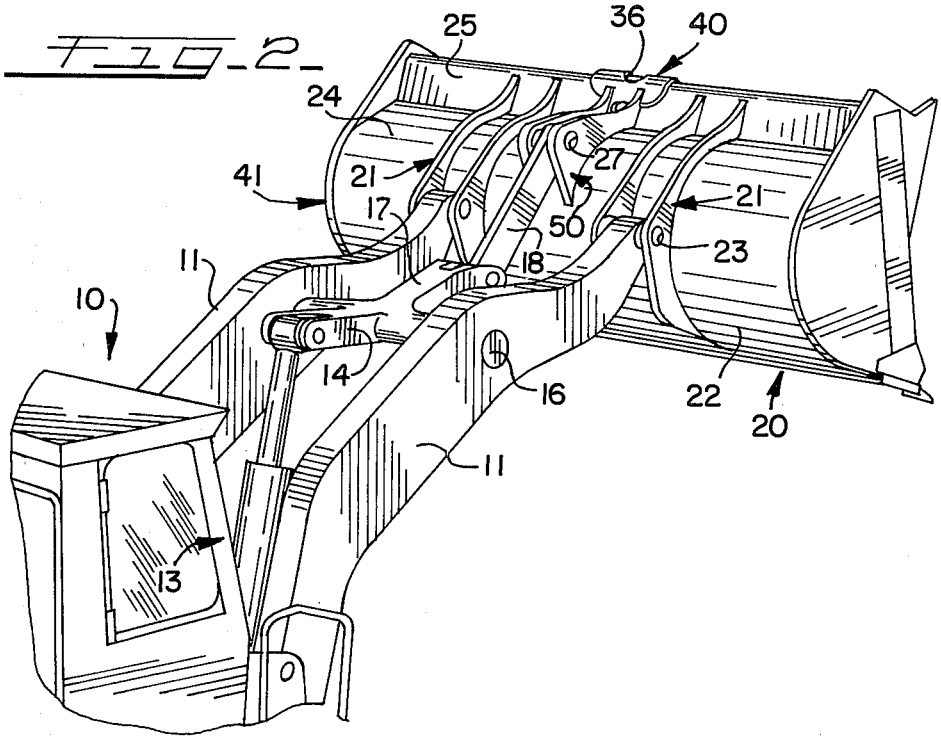
FIG. 2 is a isometric rear view of a smaller capacity bucket in a raised dump position.
Figure 5:
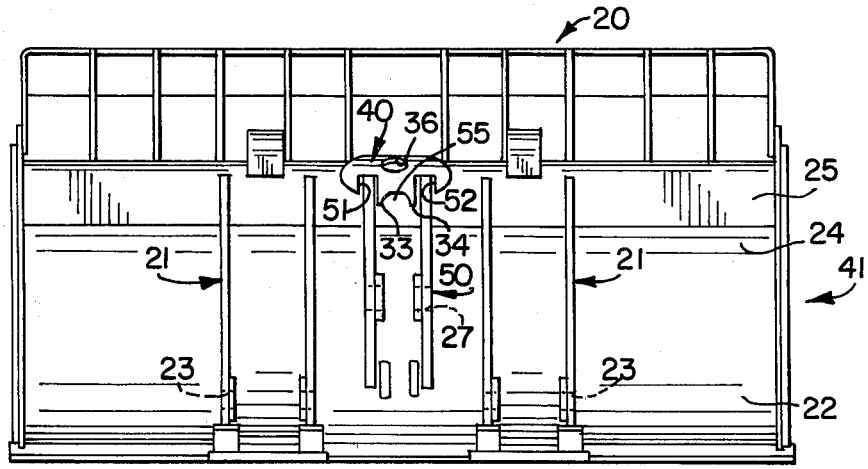
FIGS. 5 and 6 are rear and side views respectively of the smaller capacity buckets shown in FIG. 2 incorporating a second embodiment of the stress distributing member of the invention.
Figure 6:
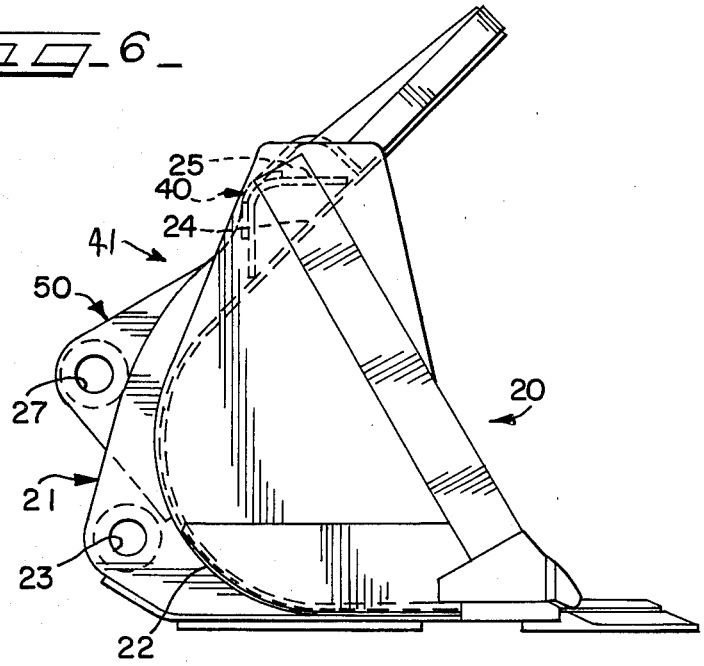
Figure 9:
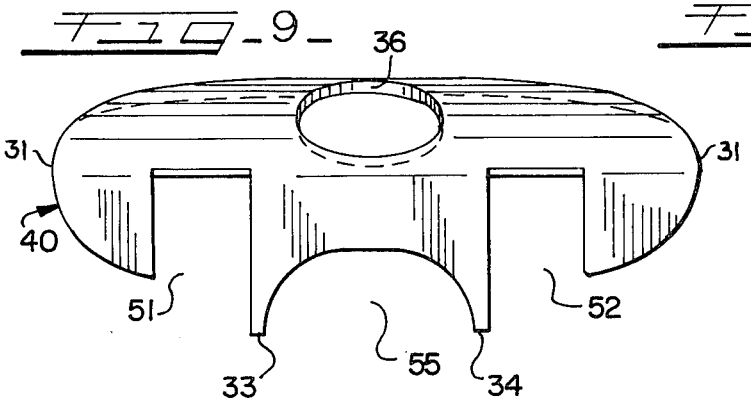
Figure 10:
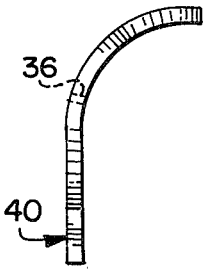
Figure 11:
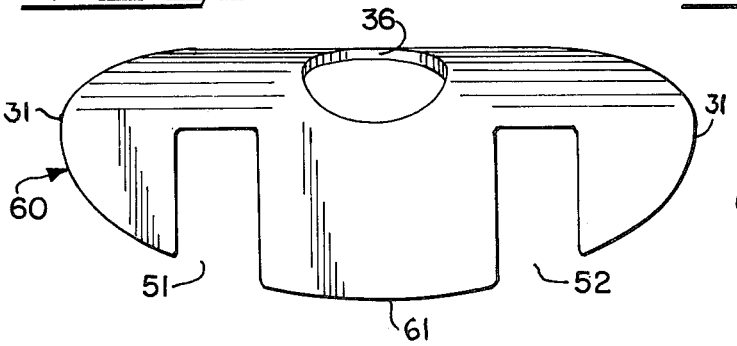
Figure 12:
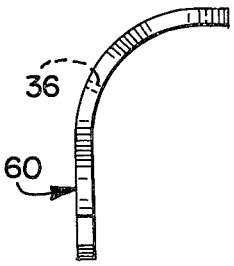

FIGS. 9 and 10 are rear and side views respectively of the stress distributing member of FIGS. 2, 5 and 6; and FIGS. 11 and 12 are rear and side views respectively of a third embodiment of the stress distributing member.

Figure 1:
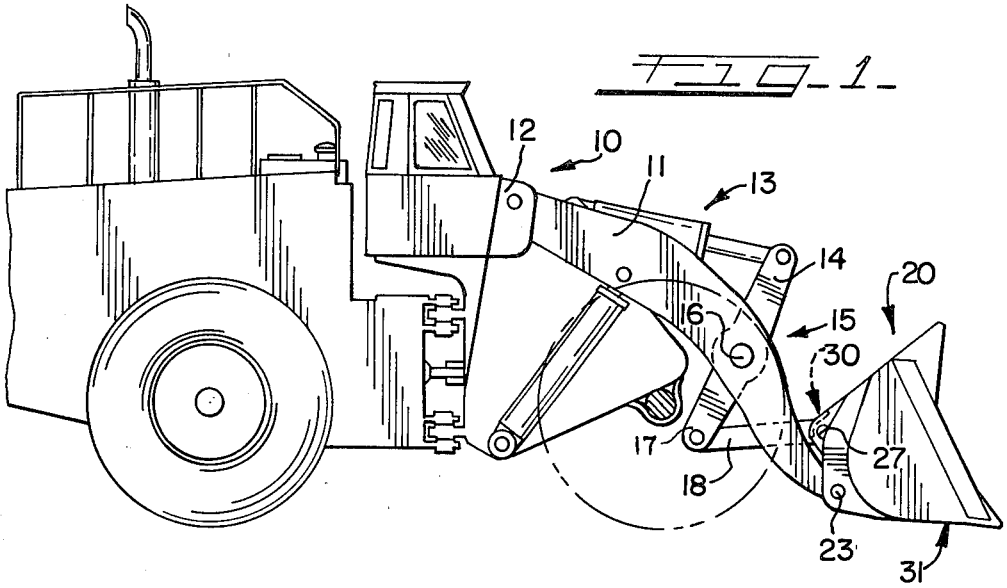
FIG. 1 is a side view of a bucket loader vehicle with a large capacity bucket.

In the exemplary embodiments of the invention disclosed in the various figures of the drawing, and with reference to FIGS. 1 and 2, a material handling bucket loader vehicle is designated generally by reference numeral 10. A pair of identical boom arms 11 are pivotally mounted at one end to the chassis 12 of the loader 10. The swingable ends of the boom arms 11 are pivotally mounted to a bucket means generally designated 20. A hydraulic piston cylinder unit 13 is pivotally mounted to the vehicle chassis 12 on the longitudinal axis of the loader 10. The piston rod of the hydraulic piston cylinder unit 13 is pivotally mounted to the upward end of rock arm 14 of bellcrank member 15 which is pivotally mounted on a transverse shaft 16 connected to the boom arms 11. The lower rock arm 17 of the bellcrank member 15 is pivotally connected to bucket tilt link 18. The opposite end of the bucket tilt link 18 is pivotally connected to the bucket structure 20 on an axis parallel with the axis of the boom arm connection to the bucket 20.

Figure 3:
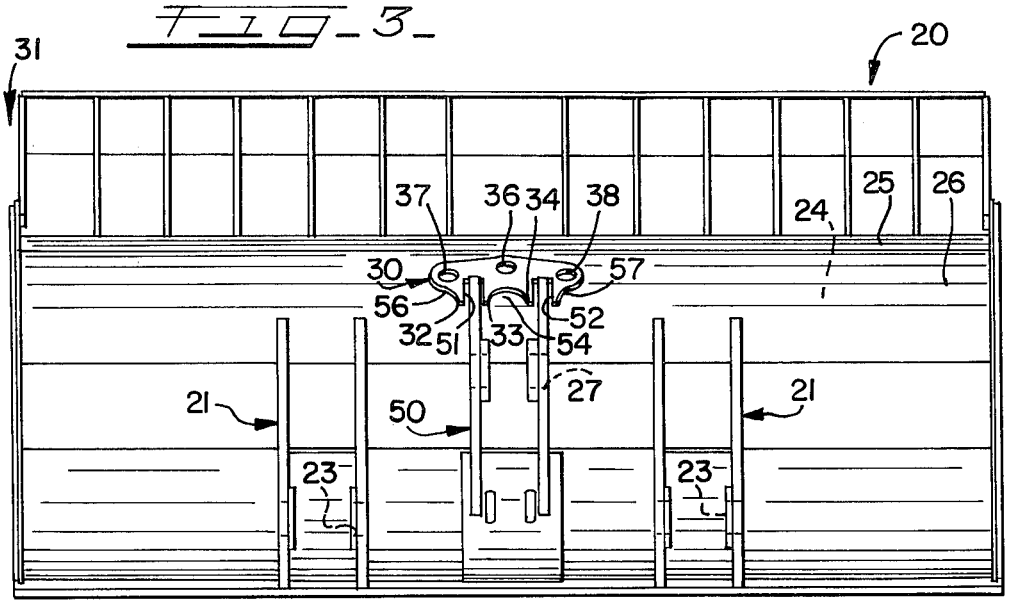
FIGS. 3 and 4 are rear and side views respectively of the large capacity buckets shown mounted on the FIG. 1 bucket loader vehicle and incorporating one embodiment of the stress distributing member of the invention.
Figure 4:
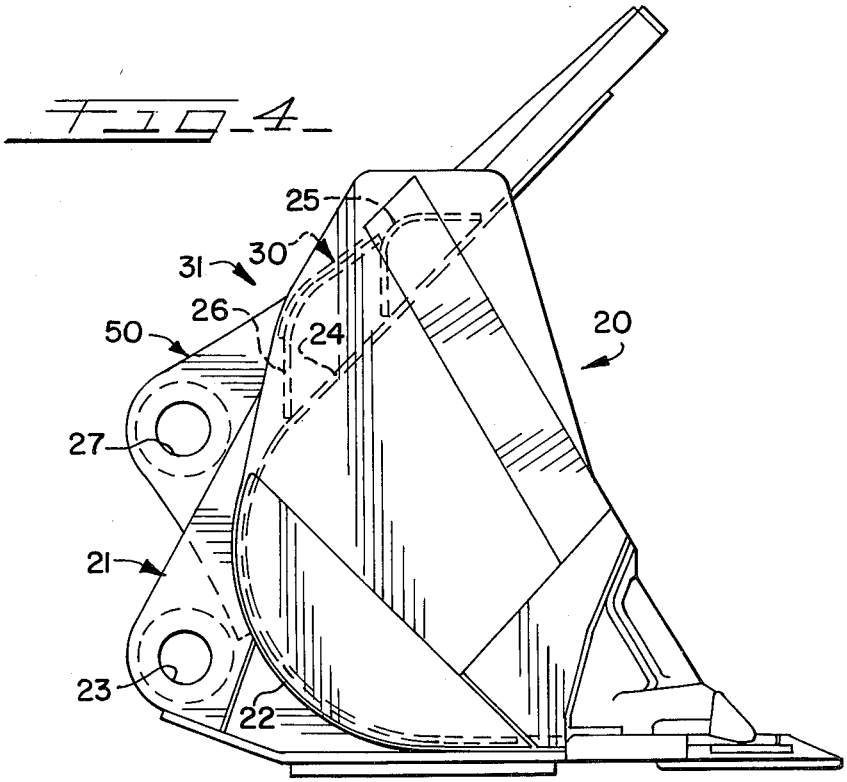
Figure 7:
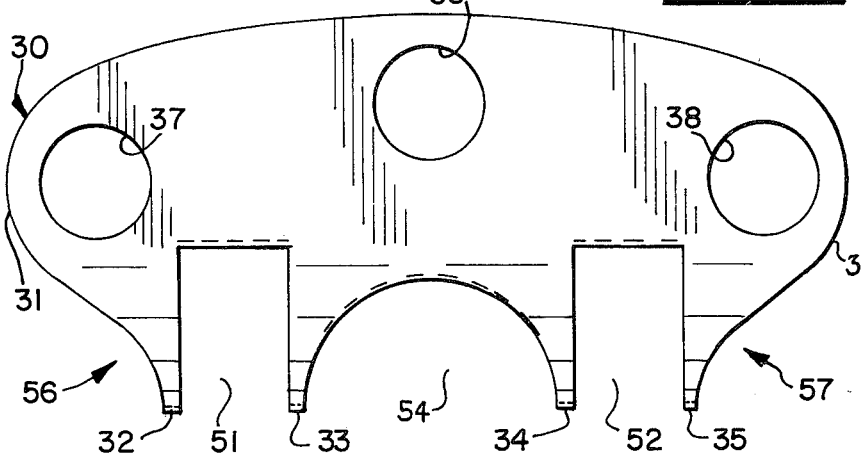
FIGS. 7 and 8 are rear and side views respectively of the stress distributing member of FIGS. 3 and 4.

With reference now to FIGS. 3–7, the large capacity bucket 31 shown in FIG. 3 and the smaller capacity bucket 41 shown in FIG. 7 have common parts which are identified by similar reference numerals. The buckets 20 each have the combination bucket bowl reinforcement ribs and boom arm hinge means 21 connected on the right and left sides of the exterior bottom bucket wall portion 22. The right and left bowl reinforcement ribs are provided with boom mounting bearings 23. A transverse reinforcement angle member 25 is welded to the upper outer wall portion 24 of each bucket 20. The large capacity bucket 31 in addition has a transversely extending torque bar 26 in the form of an obtuse angle member having one leg welded to the corner of the transverse reinforcement angle member 25 and the opposite leg welded to the merger of the upper wall portion 24 to the bottom curved portion 22 of the large capacity bucket 31.

A pair of centrally located combination bucket bowl reinforcement ribs and tilt linkage hinge means 50 are welded to the upper wall portion 24 of both buckets 20. The middle pair of reinforcement ribs 50 carries tilt link bearings 27. In the large capacity bucket 31, the terminal ends of the middle pair of bucket reinforcement ribs 50 are welded to the transversely extending torque member 26 and in the smaller capacity bucket 41, the terminal ends of the middle bucket reinforcement ribs 50 are welded to the transverse angle member 25.

Figure 8:
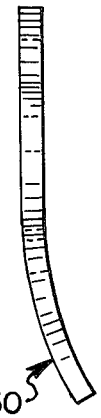

In the large capacity bucket 41, stress distributing or load resisting member 30, shown in FIGS. 7 and 8, is mounted to the exterior of the obtuse angle member or torque bar 26 and has finger-like tabs 32, 33, 34 and 35 positioned on opposite lateral sides of each reinforcement rib of the central pair of ribs 50. The body of the stress distributing member 30 is generally elliptical in shape and has a central hole or aperture 36 located on the minor axis spaced above the major axis of the ellipse. A pair of additional holes 37 and 38 are on the major axis of the ellipse and are positioned at the small curved ends 31 of the ellipse. A pair of notches 51 and 52 are provided in the body of the stress distributing member 30 which accommodate the terminal ends of the middle pair of bucket reinforcement ribs 50. The fingers 32, 33, 34 and 35 increase the depth of the notches 51 and 52. A semi-circular notch 54 is provided in the lower large curved portion centered on the minor axis of the ellipse forms the tips of the inner fingers 33 and 34. A pair of quarter radius notches 56 and 57 which merge into the small curved ends 31 of the elliptical shaped stress plate 30 form the tips of the outer fingers 32 and 35. As shown in FIG. 8 the finger portion of the elliptical plate 30 is curved to fit the contour of the torsion bar 26 and is fastened thereto by welding.

In the smaller capacity bucket 41, the stress distributing plate 40, shown in FIGS. 9 and 10 differs from the stress plate 30 in that no holes are provided on the major axis of the eclipse and there are no outermost fingers for the notches 51 and 52, and there is a semi-elliptical notch 55 in place of the semi-circular notch on the minor axis of the ellipse which provides the tips for the inner fingers 33 and 34. As shown in FIG. 10 the upper portion of the elliptical body is curved to fit the curved corner of the angle member 25 and is fastened thereto by welding.

The stress distributing member shown in FIGS. 11 and 12 differs from stress plates 30 and 40 in that the notches 51 and 52 are not provided with any finger tabs and there is no cutout portion in the large lower curved side 61 of the elliptical shaped member. Similar to stress plate 40, the upper portion of the elliptical plate member 60 is curved to fit the contour of the corner of the angle member 25 and is fastened thereto by welding.

What is claimed is:

1. In a material handling bucket having generally vertical sides end capping a generally hyperbolic shaped bucket bowl, a transverse channel member means externally mounted to an upper forward edge of the bucket bowl for reinforcing the edge, two pairs of symetrically positioned outboard bucket bowl reinforcement ribs having boom arm pin bearing mounting means for pivotally mounting the bucket to a pair of vertical swingable boom arms, at least one pair of inboard bucket bowl reinforcement ribs having bucket tilting link pin bearing mounting means for pivotally mounting a hydraulic ram powered bucket tilting link to the bucket on a transverse link pin axis parallel to and above the boom pin axis, the three pairs of bucket bowl reinforcement ribs extending on parallel planes and transversely uniformly spaced-apart between the vertical sides of bucket bowl reinforcement ribs having upper terminal end portions mounted to the channel member means; and, wherein the improvement comprises:

an oblong stress distributing plate means having at least one portion of reduced cross-sectional area defining at least one stress concentration point offset toward an upper longer side of the plate means from a predetermined midpoint of the plate means and having a lower longer side symetrically connected to the upper terminal end portions of the inboard pair of bucket bowl reinforcement ribs and to the channel member means for distributing stresses transversely across the plate means transmitted to the stress concentration point from the upper terminal end portions acting upon the channel member means in response to operation of the hydraulic ram powered bucket tilting link; said stress distributing plate means is generally elliptical in shape, and said portion of reduced cross-sectional area is a circular hole centered on the ordinate or minor axis of the ellipse and is spaced upwardly toward an upper longer curved side of the generally elliptical shaped stress distributing plate means from the abscissa or major axis of the ellipse; and connecting means are provided in a lower longer curved side of the generally elliptical shaped stress distributing plate means for mounting the terminal end portions thereto.

2. In a material handling bucket according to claim 1, wherein:

the inboard pair of bucket bowl reinforcement ribs are mounted on opposite sides of the midsection of the bucket bowl and the portion of reducted cross-sectional area defining the stress concentration point is positioned on the midsection.

3. In a material handling bucket according to claim 1, wherein:

the connecting means are a pair of generally rectangularly shaped notches symetrically positioned on opposite sides of the minor axis and having a transverse span between opposite facing sides of a width permitting welding of the facing sides to the channel member means.

4. In a material handling bucket according to claim 3, wherein:

a second stress concentration point is provided in the periphery of the lower longer curved side on the minor axis.

5. In a material handling bucket according to claim 4, wherein:

the second stress concentration point is a semi-circular notch with the center on the minor axis between the rectangular notches, and wherein the facing sides of the rectangular notches are provided with extensions forming innermost and outermost finger-like tabs depending on opposite sides of their respective upper terminal end portions.

6. In a material handling bucket according to claim 5, wherein:

the semi-circular notch merges into an outer periphery of the innermost tabs and the outermost tabs have a concave quarter-round outer periphery merging into lateral smaller curved sides of the generally elliptical shaped stress distributing plate means.

7. In a material handling bucket according to claim 4, wherein:

the second stress concentration point is a semi-elliptical notch centered between the rectangular notches, and wherein the innermost facing sides of the rectangular notches are provided with extensions forming finger-like tabs depending on opposite facing sides of the upper terminal end portions.

8. In a material handling bucket according to claim 7, wherein:

the semi-elliptical notch merges into an outer periphery of the tabs.

9. In a material handling bucket according to claim 6, wherein:

two additional round holes are provided in the generally elliptical shaped stress distributing plate means with the centers on the major axis and spaced inwardly from the lateral smaller curved sides.

10. In a material handling bucket according to claim 6, wherein:

the innermost and outermost tabs are contoured to fit over a bend in the channel member.

11. In a material handling bucket according to claim 3, or claim 8, wherein:

the upper longer curved side is contoured to fit over a bend in the channel member.

* * * * *